US006112548A

United States Patent [19]

Moenickheim

[11] Patent Number: 6,112,548

[45] Date of Patent: Sep. 5, 2000

[54] PACKAGING AND DELIVERY SYSTEM FOR AQUEOUS-BASED PRODUCTS

[76] Inventor: Peter Moenickheim, 5540 Caplestone La., Dublin, Ohio 43017

[21] Appl. No.: 09/255,230

[22] Filed: Feb. 22, 1999

[51] Int. Cl.[7] ..... F25D 3/08

[52] U.S. Cl. ..... 62/530; 62/457.2; 62/457.3

[58] Field of Search ..... 62/530, 457.2, 62/457.3

[56] References Cited

U.S. PATENT DOCUMENTS 4,886,063 12/1989 Crews ..... 62/530 X 5,641,325 6/1997 Delk et al. ..... 62/530 X 5,887,437 3/1999 Maxim ..... 62/530 X

*Primary Examiner*—Henry Bennett

*Assistant Examiner*—Chen-Wen Jiang

[57] ABSTRACT

The present invention relates to a liquid container containing a plurality of enclosed cells formed between at least a first layer and a second layer of polymeric material. Each enclosed cell contains essentially less than about 2 fluid ounces of an aqueous-based solid or liquid. Preferably, each enclosed cell contains less than about 1 fluid ounce of an aqueous-based solid or liquid. In a further aspect, the first layer and second layer of polymeric materials are perforated to allow separation of an individual enclosed cell from the remainder of the plurality of enclosed cells.

12 Claims, 2 Drawing Sheets

PACKAGING AND DELIVERY SYSTEM FOR AQUEOUS-BASED PRODUCTS

The present invention relates to a novel packaging and delivery system for aqueous-based products. The packaging and delivery system is characterized by having at least one sheet containing a plurality of individual encapsulated cells. Each cell contains an aqueous-based product. The aqueous-based product is preferably frozen distilled water.

BACKGROUND OF THE INVENTION

Water is an essential component for life. Ice is a convenience. Ice is widely available from either an ice tray in one's own refrigerator or in large bags of ice cubes. Ice trays can not be transported or stored without refrigeration for readily apparent reasons. Bags of ice cubes have the disadvantage that the cubes tend to agglomerate, particularly if the ice cubes are allowed to Melt and then are refrozen. Therefore, to the extent the bags of ice cubes must be transported, it can only be done in a refrigerated truck.

The present invention overcomes the problems associated with ice trays and bagged ice cubes by delivering a clean individually packaged aqueous product that can be repeatedly frozen and thawed.

SUMMARY OF THE INVENTION

The present invention relates to a liquid container containing a plurality of enclosed cells formed between at least a first layer and a second layer of polymeric material. Each enclosed cell contains essentially less than about 2 fluid ounces of an aqueous-based solid or liquid. Preferably, each enclosed cell contains less than about 1 fluid ounce of an aqueous-based solid or liquid.

Each enclosed cell can be shaped into substantially a cube or decorative shapes, such as a seashell, or textured.

The aqueous-based solid or liquid preferably is at least 98% water and can optionally further contain viscosity modifiers, flavorings, fragrances, colorants and preservatives. In a more preferred embodiment, the aqueous-based solid or liquid is distilled water.

A particularly preferred embodiment provides a first layer of polymeric material that has been thermoformed into a substantially cubic, decorative or textured form and the second layer of polymeric material is a flexible layer that has been removably sealed to the first layer of polymeric material.

In a still further embodiment, the first layer and second layer of polymeric materials are perforated. The first layer and second layer of polymeric materials are preferably perforated to allow separation of an individual enclosed cell from the remainder of the plurality of enclosed cells.

DETAILED DESCRIPTION OF THE INVENTION

Figure 1:
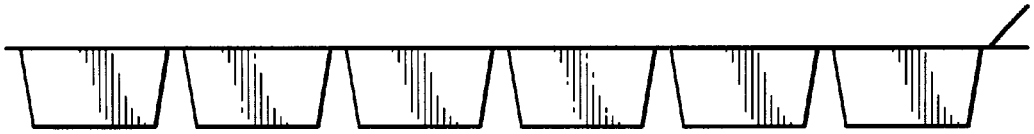
FIG. 1 is a cross-sectional view of the liquid container.
Figure 3:
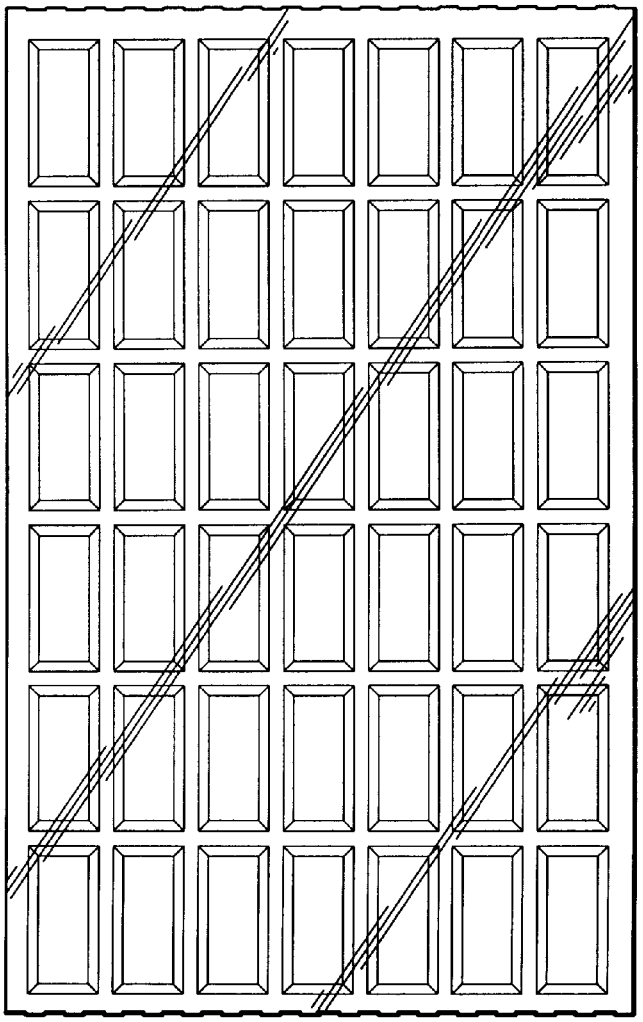
FIG. 3 is a top view of the liquid container.
Figure 2:
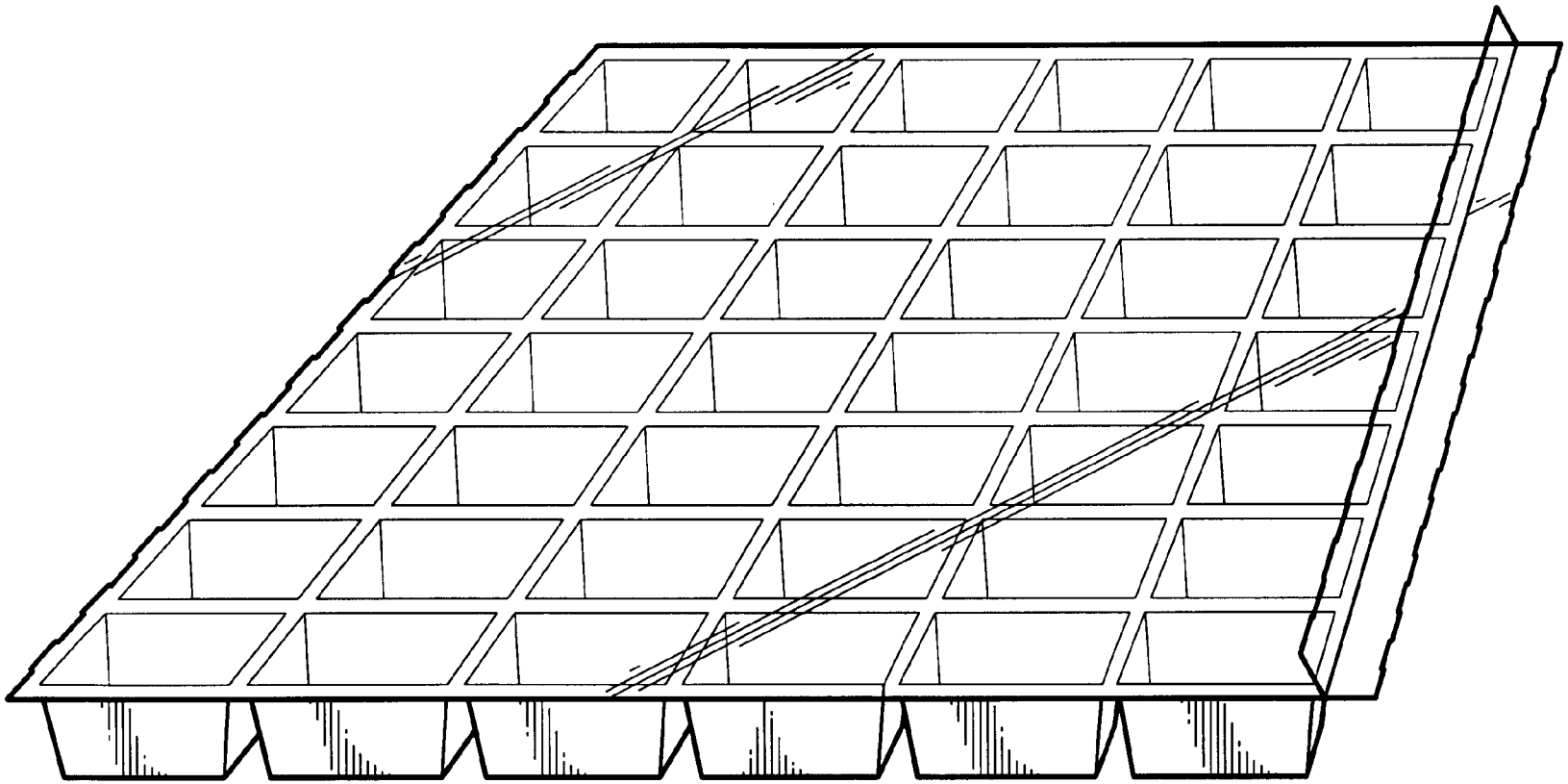
FIG. 2 is a perspective view of the liquid container.

The present invention begins with a packaging system containing individually wrapped liquid materials. The packaging system can be in the form of a blister package, thermoformed package or bubble pack. The packaging system must be capable of forming closed cells to hold a liquid or frozen aqueous material. Preferably, the closed cells are separable into individual cells and/or rows of individual cells.

A preferred packaging system has a unitary structure containing a plurality of individual portion containers shaped to hold about 0.5 fluid ounces of water. The system is preferably is made by thermoforming a polymeric material, such as polystyrene, polyvinyl chloride, and polypropylene, having a thickness of 0.010 inches. A cover for the structure can be a transparent, opaque, or pigmented polymeric material, such as polyester and mylar, or foil material. The cover is secured to the unitary structure using either an adhesive or the application of heat to form a bond between the cover and the unitary structure. The cover is preferably thin enough to be bent and yet strong enough to be pulled back off of the unitary structure to expose the contents therein.

The contents of the structure is preferably an aqueous-based liquid. An aqueous-based liquid, as the term is used herein, means a liquid made up of greater than about 90% by weight of water, more preferably greater than 98% by weight water. Viscosity modifiers, flavorings, colorants and preservatives can be added. A more preferred liquid provided in the structure is substantially pure water. Water that the average consumer can obtain from a public water supply or purchase in bottle form would be considered to be substantially pure. The most preferred contents of the structure is distilled water.

Preferred embodiments of the present invention relating to novel liquid containers and methods for using the same have been described above. Those skilled in the art having the benefit of the teachings presented in the foregoing will recognize modifications and other embodiments. Therefore, it is understood that the invention is not limited to the specific embodiments disclosed herein, and that modifications and other embodiments are intended to be within the scope of the appended claims.

We claim:

1. A liquid container comprising:

a plurality of enclosed cells formed between at least a first layer and a second layer of polymeric material that is removably attached to the first layer wherein the contents of each enclosed cell consist essentially of less than about 2 fluid ounces of an aqueous-based solid or liquid.

2. A liquid container according to claim 1 wherein each enclosed cell contains less than about 1 fluid ounce of an aqueous-based solid or liquid.

3. A liquid container according to claim 1 wherein each enclosed cell has four upstanding sides, a top and a bottom which form substantially a cube.

4. A liquid container according to claim 1 wherein the aqueous-based solid or liquid comprises at least 98% water and optionally further comprising viscosity modifiers, flavorings, fragrances, colorants and preservatives.

5. A liquid container according to claim 4 wherein the aqueous-based solid or liquid is distilled water.

6. A liquid container according to claim 1 wherein the first layer of polymeric material has been thermoformed into a substantially cubic shape and the second layer of polymeric material has been removably sealed to the first layer of polymeric material such that removal of at least one layer exposes the contents therein.

7. A liquid container according to claim 6 wherein the aqueous-based solid or liquid comprises at least 98% water and optionally further comprising viscosity modifiers, flavorings, fragrances, colorants and preservatives.

8. A liquid container according to claim 7 wherein the aqueous-based solid or liquid is consumable and further comprises flavoring or colorant.

9. A liquid container according to claim 1 wherein the first layer and second layer of polymeric materials are perforated.

10. A liquid container according to claim 9 wherein the first layer and second layer of polymeric materials are perforated to allow separation of at least one enclosed cell from the remainder of enclosed cells.

11. A liquid container according to claim 1 wherein at least one layer of polymeric material forming the enclosed cells has a textured surface.

12. A liquid container according to claim 1 wherein at least one layer of polymeric material forming the enclosed cells has a surface or a plurality of surfaces that form a decorative shape.

* * * * *